United States Patent [19]

Kimmel

[11] 4,257,085

[45] Mar. 17, 1981

[54] WARNING LANTERN ADAPTER

[76] Inventor: Robert M. Kimmel, 8721 Patton Rd., Wyndmoor, Pa. 19118

[21] Appl. No.: 37,208

[22] Filed: May 8, 1979

[51] Int. Cl.[3] ..... F21L 7/00

[52] U.S. Cl. ..... 362/186; 362/307; 362/361

[58] Field of Search ..... 362/186, 307, 361

[56] References Cited

U.S. PATENT DOCUMENTS 3,875,561 4/1975 Scarpino et al. ..... 362/363 X

*Primary Examiner*—Stephen J. Lechert, Jr.

*Attorney, Agent, or Firm*—Steele, Gould & Fried

[57] ABSTRACT

Apparatus for illuminating a work area while simultaneously providing a safety beacon-type warning light comprising: a source of illumination which provides a light beam; means to direct a beam of light from said source of illumination to said work area; and structure to provide a beacon-type warning light which utilizes light from said source of illumination not being directed to said work area.

14 Claims, 5 Drawing Figures

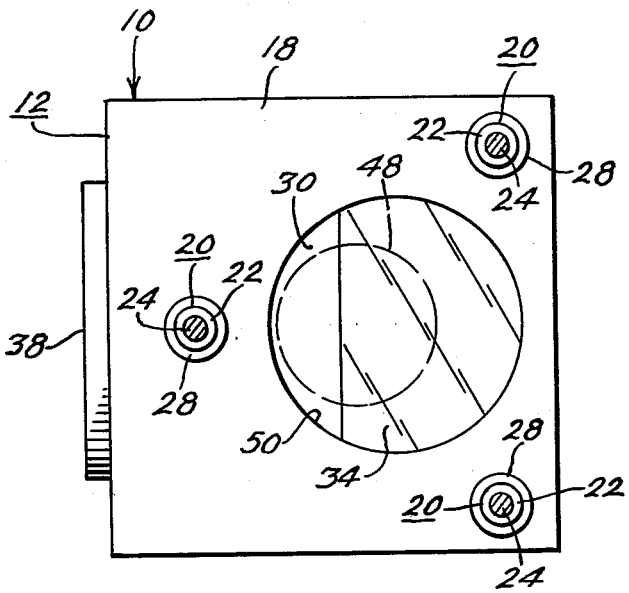
FIG.3.
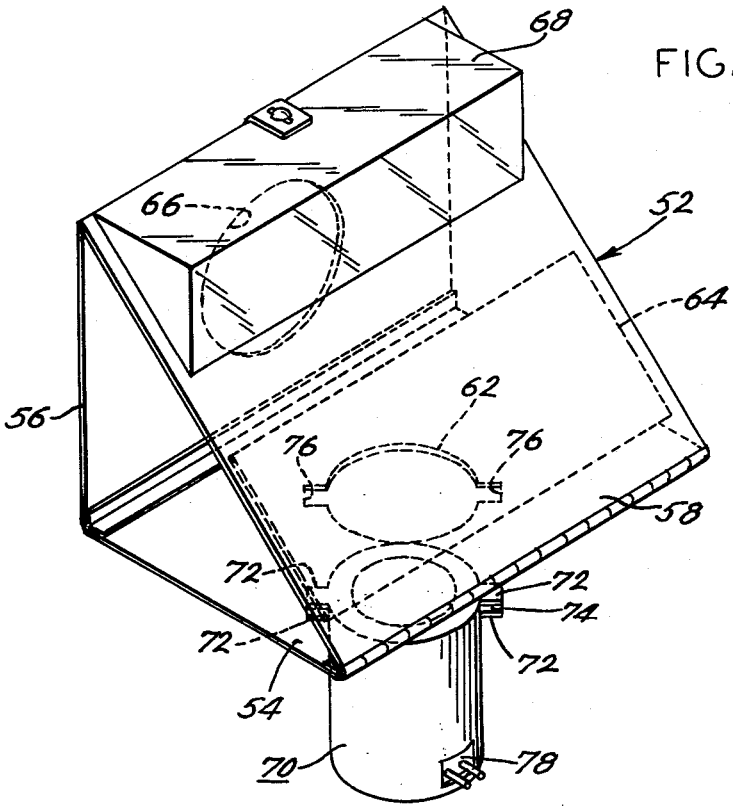
FIG.4.
FIG.5.
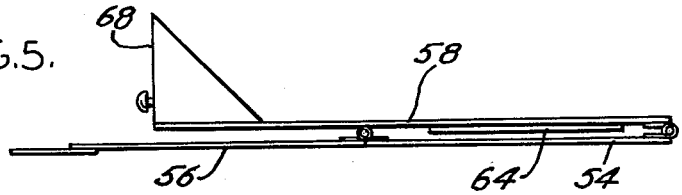

WARNING LANTERN ADAPTER

BACKGROUND OF THE INVENTION

The subject invention relates to safety devices generally and particularly to a type appropriate for use with motor vehicles. Despite improvements in technology, flat tires and blowouts remain a fairly common occurrence and presently existing equipment does not adequately protect a person forced to repair such a tire under dangerous roadside conditions.

While flares, reflectors, and other types of signaling devices are helpful in alerting oncoming motorists to the presence of a disabled vehicle, these types of devices do not assist the motorist in illuminating the work area such as the tire locations. Also, standard lighting beams such as flashlights are difficult to work with, particularly when one is alone, since the device cannot be positioned readily to cast light on the work area.

Thus, there is a need for a device which not only provides illumination to warn oncoming motorists of a disabled vehicle, and more particularly of a person performing repairs on said vehicle, but also a device is needed to support standard lighting means, such as a flashlight, and direct its beam of light to a work area, eliminating the necessity of a second person to hold and aim such a light.

SUMMARY OF THE INVENTION

Accordingly, it is an object of the subject invention to provide apparatus which both serves as a beacon-type signal to warn oncoming motorists of one's presence, and additionally directs light to a work area.

It is a further object of the subject invention to provide apparatus which serves as a beacon-type signal and directs light to a work area, which apparatus may be used with a conventional flashlight.

It is a further object of the subject invention to provide safety apparatus as noted above which is readily compact and can be stored in a motor-repair kit.

Accordingly, safety apparatus of the subject invention includes an adaptable unit which may be used in conjunction with a standard flashlight to provide both signaling means and a means of directing light to a work area. The unit comprises a reflective portion which, in conjunction with a lens, will channel and cast the light in a direction toward where work is being performed. The unit is to be physically positioned by the user so as to achieve a directional use of the light. Light, which is not so directed by the reflective surface, will serve to cause illumination by being received by a red, yellow or otherwise bright transparent beacon, thus enabling the location to be seen from a distance, such as by oncoming motorists. The support means for the unit may be adjustable and collapsible by either being foldable or telescopic. Where the source of illumination is a separate flashlight, the flashlight may serve as a portion of the support means. In one embodiment, the entire unit is collapsible.

BRIEF DESCRIPTION OF THE DRAWINGS

FIG. 3 is a section view of the safety apparatus of FIG. 2, taken along line 3—3.

FIG. 4 is a perspective view of an alternate embodiment of the subject invention, which unit is collapsible.

FIG. 5 is a side view of the apparatus of FIG. 4 shown in a collapsed condition.

DETAILED DESCRIPTION OF THE INVENTION

Figure 1:
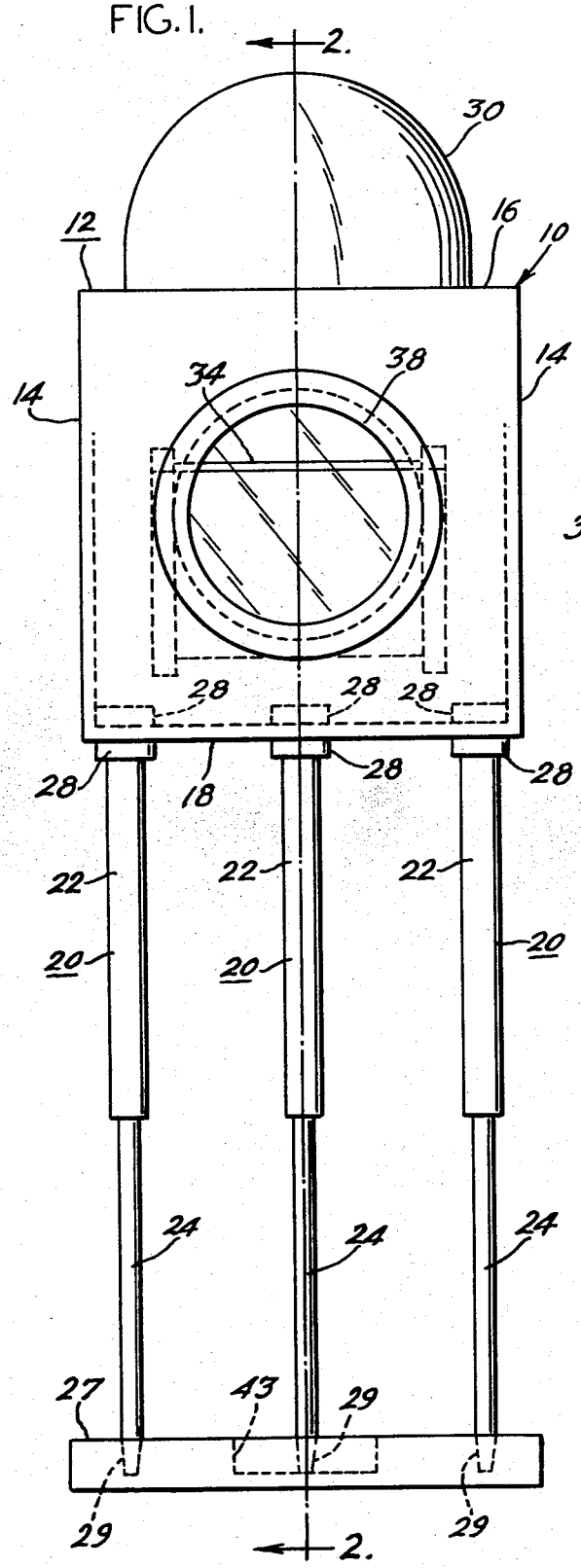
FIG. 1 is a front elevational view of the safety apparatus of the subject invention.

With reference to FIG. 1, a safety and lighting device 10 is shown comprising a housing 12 having side walls 14, a top member 16 and bottom member 18. The walls 14, top and bottom members 16, 18, may be constructed of plastic or suitable equivalent.

Figure 2:
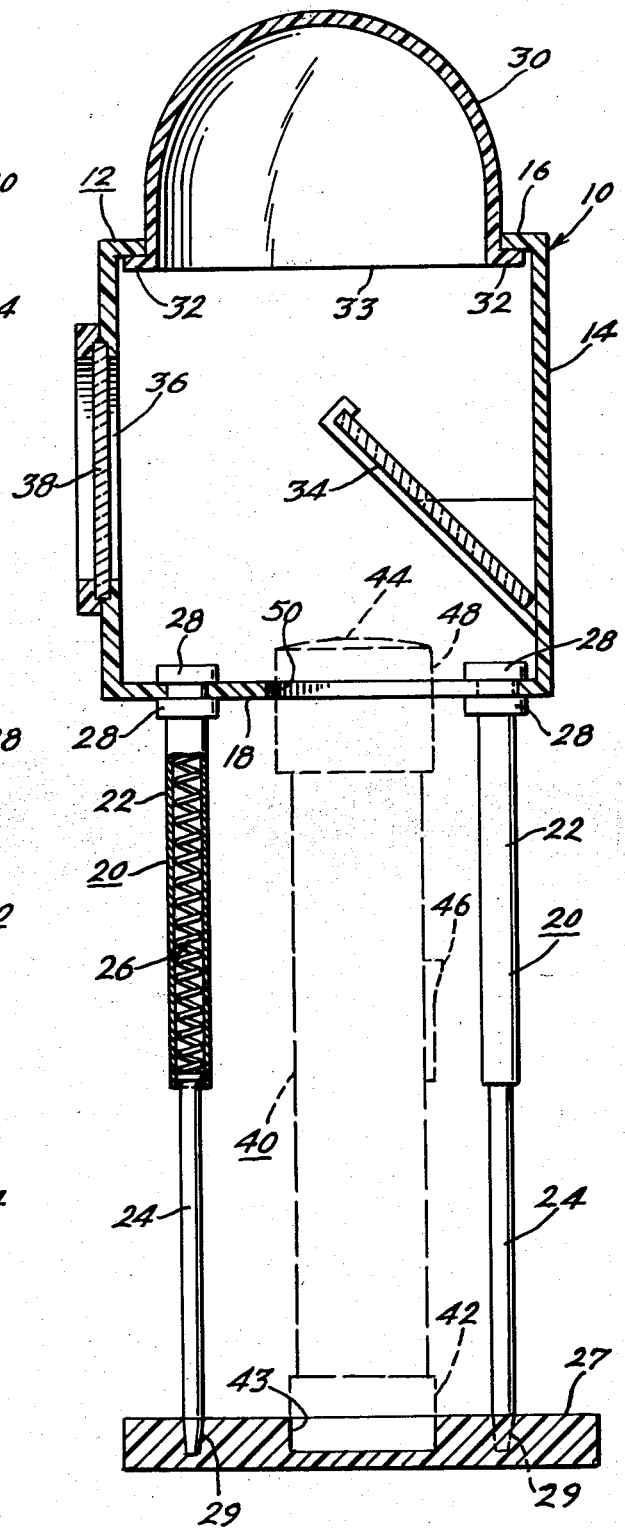
FIG. 2 is a side cross-sectional view of the safety apparatus of FIG. 1, taken along line 2—2.

The housing 12 is shown in FIGS. 1 and 2 being supported by three legs 20. The legs 20 are telescopic, having upper portions 22 and lower portions 24, the lower portions 24 being slideable within upper portions 22. The lower portions 24 are spring loaded inside the upper portions by spring means 26, and may engage lower support member 27, which has corresponding openings 29 for the tips of the lower portions 24. The upper portions 22 of the leg 20 are shown as being detachably mounted to the bottom 18 and may be threadably engageable therein. Lock nuts 28 are shown. As with the housing 12, the leg elements 20 may be plastic or an equivalent. Detachably mounted on top member 16 is a plastic colored transparent beacon-like bubble member 30. The beacon-like bubble member 30 is secured to top member 16 by means of flanges 32 which can, for removal purposes, clear circular openings 33 in top member 16 when the sides of the beacon-like bubble member 30 are compressed slightly, as by finger pressure, for example.

As further seen in FIGS. 1 and 2, and particularly FIG. 2, a mirror or other type of reflective element 34 is mounted on an incline within housing 12 and more particularly to side wall 14. The mirror element 34 may have a backing intrinsically constructed with side wall 14 or it may be mounted by other means, such as clamps, adhesive mounting or other equivalent type of construction.

An opening 36 exists through the side wall opposite to the one where reflective element 34 is mounted with the opening being covered by a suitable projecting lens 38, such as a double convex lens.

A standard flashlight 40 is shown in FIG. 2, having a base 42, head portion 44, and actuation means 46. Bottom member 18 has an opening 48 with a rubber grommet 50 placed therein to enable the head portion 44 of the flashlight 40 to be inserted therein and frictionally held in place. The opening 48 with grommet 50 can best be seen looking at the bottom view of the apparatus, as shown in FIG. 3. The base 42 is insertable into a further larger opening 43 in lower support member 27. The spring loaded legs 20 will assure that the length of legs 20 will automatically adjust to the length of flashlight 40.

In case of emergency, the device 10 of FIGS. 1-3 can be quickly assembled with legs 20 being connected to housing 16, assuming the unit is originally stored in a disassembled condition. Once the legs 20 are in position, the flashlight 40 may be securedly positioned in opening 48 in the base member 18 of housing 16. When the flashlight 40 is turned on, it becomes apparent that part of the light beam will reflect off of mirror surface 34 through lens 38 in a direction perpendicular to the original direction of the beam of light. Part of the light, however, will miss the mirror 34 and illuminate the beacon-type bubble 30 on the top of the housing. It can be appreciated that when the bubble 30 is illuminated, the unit becomes visible from a distance, and of course to oncoming motorists when the device is used in the proximity of a disabled vehicle. The unit is to be positioned so that lens 38 faces the work area, such as a flat tire, so that the horizontally extending beam of light will be directed to the work area.

With reference to FIG. 4, an alternate embodiment of the device of FIGS. 1–3 is shown. The unit 52 is shown comprising a base 52 to which a perpendicularly positionable back member 56 and inclined front member 58 are shown hingedly mounted. The unit 52 may have side walls, not shown, also hingedly mounted to base member 54.

Base member 54 has an opening 62 for receiving a flashlight or other light means 70, having a generally cylindrical case and provided with two sets of mounting tabs 72, defining slots 74 between them. Opening 62 has two oppositely disposed peripheral slots 76, into which mounting tabs 72 may be inserted. After insertion, light means 70 and unit 52 are rotated with respect to one another, so that the lip of opening 62 is engaged by tabs 72, resting in slots 74. Inclined front member 58 has mounted thereto a mirror or reflective unit 64 positioned to reflect a beam from the light means positioned at opening 62, through projecting lens 66 in back member 56. A transparent unit 68, which may be colored red, yellow or another bright color, is mounted at the top of inclined front member 58 in such a position as to receive light from the beam of the light means which passes reflective unit 64. As shown in FIG. 5, the unit of FIG. 4 is collapsible to enable compact storage thereof.

The unit of FIGS. 4 and 5 may include legs, as were used with the embodiment of FIGS. 1–3, or the light, which is to be used in conjunction with the device of FIG. 4, can provide means of support for the unit 52, assuming the base of the light means is of sufficient size. The light means may provide a housing for batteries or rechargeable batteries, the latter utilizing socket means 78.

Either the unit of FIGS. 1–3 or FIGS. 4–5 can be readily stored in a motor repair kit or otherwise in a car trunk and quickly assembled into operative condition when needed. The flashlight, to be used with the unit, may be used for other purposes as well as providing the source of illumination for the subject devices, 10, 52.

When the subject invention is utilized, not only is light cast upon the work area, but the illuminated beacon bubble or transparent element 30, 68, provides a safety warning device which is kept in close proximity to the user, as for example, close to a flat tire which may be a work area. With flares or other safety elements, there is a tendency to place the elements remote from the disabled vehicle to signal the vehicle's presence; and the use of an illuminated device at the work area is overlooked, thus creating a safety hazard, as, for example, where the motorist must repair a flat tire on a road side.

The present invention may be embodied in other specific forms without departing from the spirit or essential attributes thereof, and accordingly, reference should be made to the appended claims rather than to the foregoing specification as indicating the scope of the invention.

I claim:

1. Apparatus for illuminating a work area while simultaneously providing a safety beacon-type warning light comprising:

means for holding an independently operable, normally hand-held source of illumination which provides a first directional light beam;

means for diverting a portion of said first directional light beam from said source of illumination of said work area, in a second directional light beam; and, structure providing an omni-directional beacon-type warning light which utilizes the remainder of light from said first directional light beam not being diverted to said work area.

2. The apparatus of claim 1 further including support means for holding said apparatus in an elevated position.

3. The apparatus of claim 1 wherein said independently operable source of illumination is a conventional flashlight and said holding means are integral therewith.

4. The apparatus of claims 1 or 3 wherein said means for diverting is a reflective surface.

5. The apparatus of claim 4 wherein said reflective surface intersects a portion of said first directional light beam provided by said source of illumination.

6. The apparatus of claim 2 wherein said support means is collapsible.

7. The apparatus of claim 6 wherein said support means comprises foldable legs.

8. The apparatus of claim 6 wherein said support means comprises telescopic legs.

9. The apparatus of claim 1 further comprising a housing.

10. The apparatus of claim 9 wherein a portion of said housing comprises the beacon-type structure.

11. The apparatus of claim 9 wherein said housing is collapsible.

12. The apparatus of claim 1 wherein said means to divert comprises a reflective surface and a concave lens.

13. The apparatus of claim 1 wherein said source of illumination comprises a flashlight positioned so that its beam of light is directed upwardly; wherein said means for diverting comprises a reflective surface diagonally positioned above and intersecting said first directional light; further comprising a lens positioned parallel to said unreflected beam of light, so as to intersect the reflected portion of said beam to direct said light to said work area; and, wherein said beacon-type warning light structure is positioned above and to the side of said reflective surface to receive light which was not intersected by said reflective surface.

14. Attachment apparatus for use with a conventional flashlight comprising: means to connect said attachment apparatus to said flashlight; reflective means to direct a portion of a first directional beam of light from said flashlight to a work area, in a second directional beam of light; and, illuminating omni-directional beacon-type structure which utilizes that light from said first directional light beam not forming the second directional light beam being directed to said work area.

* * * * *